US008292707B2

(12) United States Patent
Grisham et al.

(10) Patent No.: US 8,292,707 B2
(45) Date of Patent: Oct. 23, 2012

(54) OFF-PEAK AIR INTAKE VENT

(75) Inventors: Phillip R. Grisham, Dallas, TX (US); Robert Bradley Holland, Rowlett, TX (US)

(73) Assignee: Air Vent, Inc., Dallas, TX (US)

( * ) Notice: Subject to any disclaimer, the term of this patent is extended or adjusted under 35 U.S.C. 154(b) by 1064 days.

(21) Appl. No.: 11/943,936

(22) Filed: Nov. 21, 2007

(65) Prior Publication Data

US 2009/0130969 A1 May 21, 2009

(51) Int. Cl.
*F24F 7/02* (2006.01)

(52) U.S. Cl. ..... 454/260

(58) Field of Classification Search ..... 454/339, 454/364, 365, 366, 260; 52/95, 94, 302.1, 52/302.3

See application file for complete search history.

(56) References Cited

U.S. PATENT DOCUMENTS

| | | | | |
|---|---|---|---|---|
| 3,524,400 | A * | 8/1970 | Magi | 454/78 |
| D256,047 | S | 7/1980 | Wormington | |
| 4,212,692 | A | 7/1980 | Rasen et al. | |
| 4,214,510 | A * | 7/1980 | Ward | 454/260 |
| 4,252,590 | A | 2/1981 | Rasen et al. | |
| 4,315,392 | A | 2/1982 | Sylvest | |
| 4,393,634 | A | 7/1983 | McDermott et al. | |
| RE31,599 | E | 6/1984 | Rasen et al. | |
| 4,530,193 | A | 7/1985 | Ochs | |
| 4,689,258 | A | 8/1987 | Slosberg | |
| 4,805,367 | A | 2/1989 | Kleckner | |
| 4,810,573 | A | 3/1989 | Harriett | |
| 4,843,953 | A | 7/1989 | Sells | |
| 4,852,517 | A | 8/1989 | Smith | |
| 4,903,445 | A * | 2/1990 | Mankowski | 52/199 |
| 4,942,699 | A | 7/1990 | Spinelli | |
| 4,996,812 | A | 3/1991 | Venable | |
| 5,054,377 | A | 10/1991 | Mochel et al. | |
| 5,099,627 | A | 3/1992 | Coulton et al. | |
| 5,174,076 | A * | 12/1992 | Schiedegger et al. | 52/199 |
| 5,238,450 | A | 8/1993 | Rotter | |
| D342,129 | S | 12/1993 | Goetz, Jr. | |
| 5,439,417 | A | 8/1995 | Sells | |
| 5,458,538 | A * | 10/1995 | MacLeod et al. | 454/365 |

(Continued)

FOREIGN PATENT DOCUMENTS

GB 2083204 A * 3/1982

(Continued)

OTHER PUBLICATIONS

Trimline Building Products, "Off-Peak Vent Installation Instructions," www.trimline-products.com, © 2006 Diversi-Plast, a Division of Liberty Diversified Industries.

(Continued)

*Primary Examiner* — Steven B McAllister
*Assistant Examiner* — Brittany E Towns
(74) *Attorney, Agent, or Firm* — Duane Morris LLP

(57) ABSTRACT

An off-peak intake vent includes spaced top and bottom walls defining a cavity therebetween and a pair of lateral side walls. The bottom wall has a generally planar bottom surface having at least one vent opening formed therethrough for communicating with an opening in a roof deck. The top wall has a curved portion that converges with the bottom wall at an uphill edge of the intake vent. The intake vent also includes air intake louvers defined between the top and bottom walls.

25 Claims, 19 Drawing Sheets

U.S. PATENT DOCUMENTS

| | | | | |
|---|---|---|---|---|
| 5,573,844 | A | 11/1996 | Donovan et al. | |
| 5,630,752 | A | 5/1997 | Gubash | |
| 5,797,222 | A * | 8/1998 | Martin | 52/198 |
| 5,832,677 | A | 11/1998 | Kurttila | |
| 5,946,868 | A | 9/1999 | Morris | |
| 5,947,817 | A | 9/1999 | Morris et al. | |
| 6,068,551 | A | 5/2000 | Oremland | |
| 6,086,755 | A | 7/2000 | Tepper | |
| 6,129,628 | A | 10/2000 | O'Hagin et al. | |
| 6,212,833 | B1 | 4/2001 | Henderson | |
| D442,273 | S | 5/2001 | Pestell | |
| 6,283,852 | B1 * | 9/2001 | Igo | 454/365 |
| 6,296,912 | B1 | 10/2001 | Zickell | |
| 6,371,847 | B2 * | 4/2002 | Headrick | 454/365 |
| 6,418,692 | B1 * | 7/2002 | Freshwater et al. | 52/553 |
| 6,447,392 | B1 | 9/2002 | Henderson | |
| 6,482,084 | B2 | 11/2002 | Hansen | |
| 6,487,826 | B1 | 12/2002 | McCorsley et al. | |
| 6,881,144 | B2 * | 4/2005 | Hansen et al. | 454/365 |
| 7,044,852 | B2 | 5/2006 | Horton | |
| D549,316 | S | 8/2007 | O'Hagin et al. | |
| D555,237 | S | 11/2007 | O'Hagin | |
| 2001/0019941 | A1 | 9/2001 | Headrick | |
| 2002/0016150 | A1 * | 2/2002 | Hansen | 454/365 |
| 2002/0078651 | A1 | 6/2002 | Freshwater et al. | |
| 2002/0100232 | A1 * | 8/2002 | Robinson et al. | 52/198 |
| 2004/0088928 | A1 | 5/2004 | Headrick, II et al. | |
| 2005/0054284 | A1 * | 3/2005 | Ciepliski et al. | 454/365 |
| 2006/0079173 | A1 * | 4/2006 | Coulton et al. | 454/365 |
| 2007/0049190 | A1 * | 3/2007 | Singh | 454/365 |

FOREIGN PATENT DOCUMENTS

| | | | |
|---|---|---|---|
| GB | 2186898 | A | 8/1987 |
| GB | 2335666 | A * | 9/1999 |
| GB | 2425319 | A * | 10/2006 |

OTHER PUBLICATIONS

SmartVent by DCI, DCI Products, Inc.—SmartVent Off-Peak Application, www.dciproducts.com, © 2005.

SmartVent by DCI, Tapered Under-Shingle Attic Ventilation, www.dciproducts.com, © 2005.

* cited by examiner

OFF-PEAK AIR INTAKE VENT

FIELD OF THE INVENTION

The present invention relates to ventilation systems for roofs, and more specifically to off-peak air intake vents.

BACKGROUND OF THE INVENTION

Off-peak (lower intake) ventilation is used to complement standard industry attic exhaust ventilation systems. Roof mounted, shingle-over attic ventilation devices are designed to ingest air into the attic space from the edge of the roof. Air is ingested into the intake vent and passes through the vent into the attic space via a horizontal slot cut into the roof deck. The interior space is then vented via a ridge vent at or near the peak of the roof or other ventilation system.

Improvements to these intake vents are desired.

SUMMARY OF THE INVENTION

An off-peak intake vent includes spaced top and bottom walls defining a cavity therebetween and a pair of lateral side walls. The bottom wall has a generally planar bottom surface having at least one vent opening formed therethrough for communicating with an opening in a roof deck. The top wall has a curved portion that converges with the bottom wall at an uphill edge of the intake vent. The intake vent also includes air intake louvers defined between the top and bottom walls.

In one embodiment of an off-peak intake vent, the intake vent has spaced top and bottom walls defining a cavity therebetween and a pair of lateral side walls. The bottom wall has a generally planar bottom surface having a vent defined therethrough for communicating with an opening in a roof deck. The intake vent includes air intake louvers defined between the top and bottom walls and an internal baffle system for baffling air flow between the intake louvers and the vent of the bottom wall. The internal baffle system includes first and second spaced baffles extending across the intake vent between the side walls, where the first baffle protrudes from a first wall of the spaced top and bottom walls in a first direction and a second baffle protrudes from a second of the spaced top and bottom walls in a second direction, whereby intake air is first directed in a first direction by the first baffle and then in a second direction by the second baffle.

In another embodiment of an off-peak intake vent, the intake vent has at least one internal baffle extending from the bottom wall and across the intake vent between the side walls. The bottom wall includes a planar internal surface defined between the air intake louvers and the internal baffle for draining water towards the louvers. At least one drainage channel extends between the louvers and the internal baffle that communicates with a corresponding drainage opening in the internal baffle for draining water from a side of the internal baffle opposite the intake louvers.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1A:
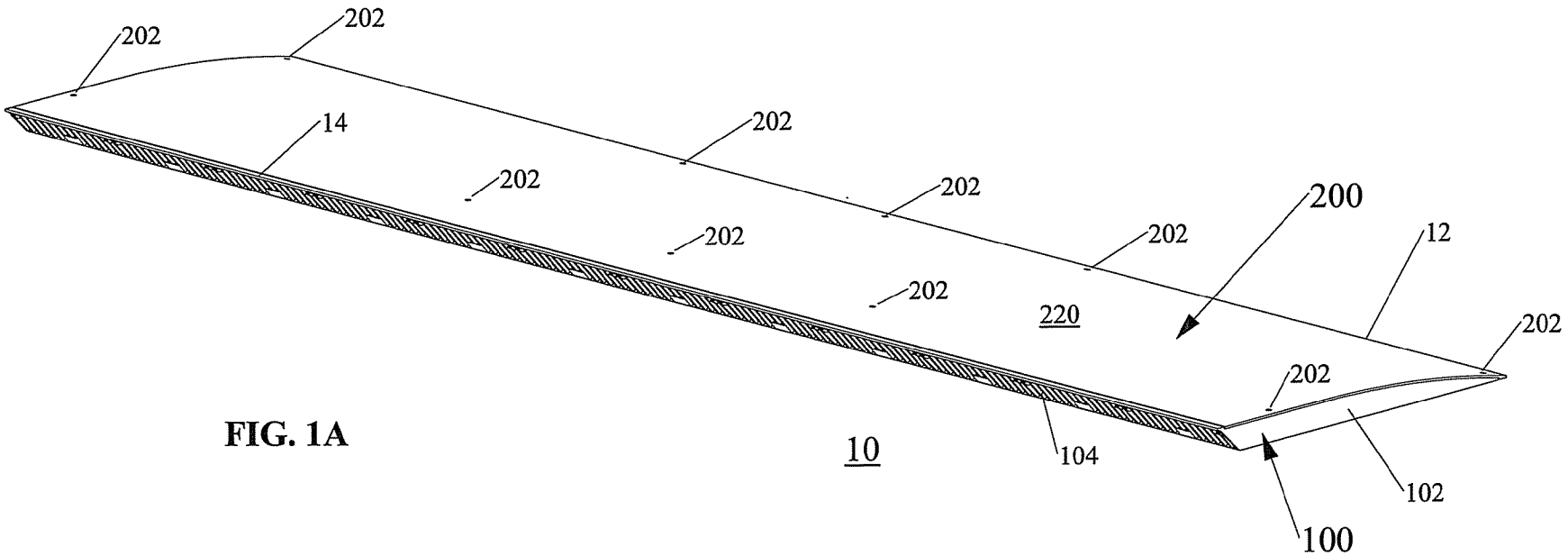
FIG. 1A is a perspective view of an intake vent of the present invention.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

An off-peak or lower intake vent for use as part of a ventilation system for a structure is described herein in connection with FIGS. 1A-1G, 2A-2E and 3A-3F. Methods of installing these types of intake vents in roofing systems are known in the art and need not be repeated herein. For example, U.S. Pat. No. 6,487,826 to McCorsley et al., the entirety of which is herby incorporated herein by reference, shows a building structure with a slot formed in the roof decking and an air-permeable plug disposed over the slot and under the shingles. In installations of the present invention, the intake vent disclosed herein would take the place of the air-permeable plug of McCorsley et al.

FIG. 1A is a perspective view of a lower intake vent 10 according to one embodiment of the present invention. FIG. 1C is a top plan view of the intake vent 10. In one embodiment, the intake vent 10 is assembled from separately formed bottom and top sections 100, 200. A venting cavity is formed between the top wall 220 and the bottom wall 142 (FIG. 1E). Nail holes 202 are formed through the intake vent 10, in which nails can be aligned and driven into the roof deck and/or rafters to secure the intake vent 10 to the building structure. Air enters the intake vent at air intake louvers 104 positioned between the top wall 220 and the bottom wall 142, bottom wall 142 being the planar wall that rests on the roof deck when the intake vent 10 is installed. Louvers 104 are rectangular slotted openings positioned below the drip edge 14 that allow air to be ingested into the vent based on the pressure conditions associated with wind flowing over a structure with a pitched roof, thermal buoyancy in the attic, a powered attic ventilation system, etc. The ribs at the louver locations are the first line of defense against weather and insect infiltration. The vent 10 includes a pair of side walls 102, sometimes referred to in the industry as "end plugs," that seal off the vent cavity and prevent the lateral entry of weather elements, debris and insects, while also providing support for the top wall 220.

Figure 1B:
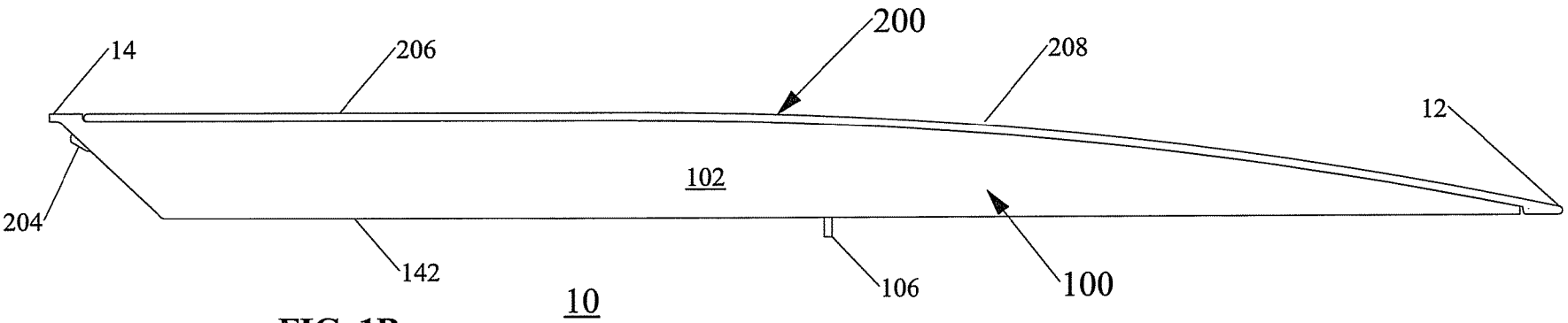
FIG. 1B is a side view of the intake vent of FIG. 1A.
Figure 1C:
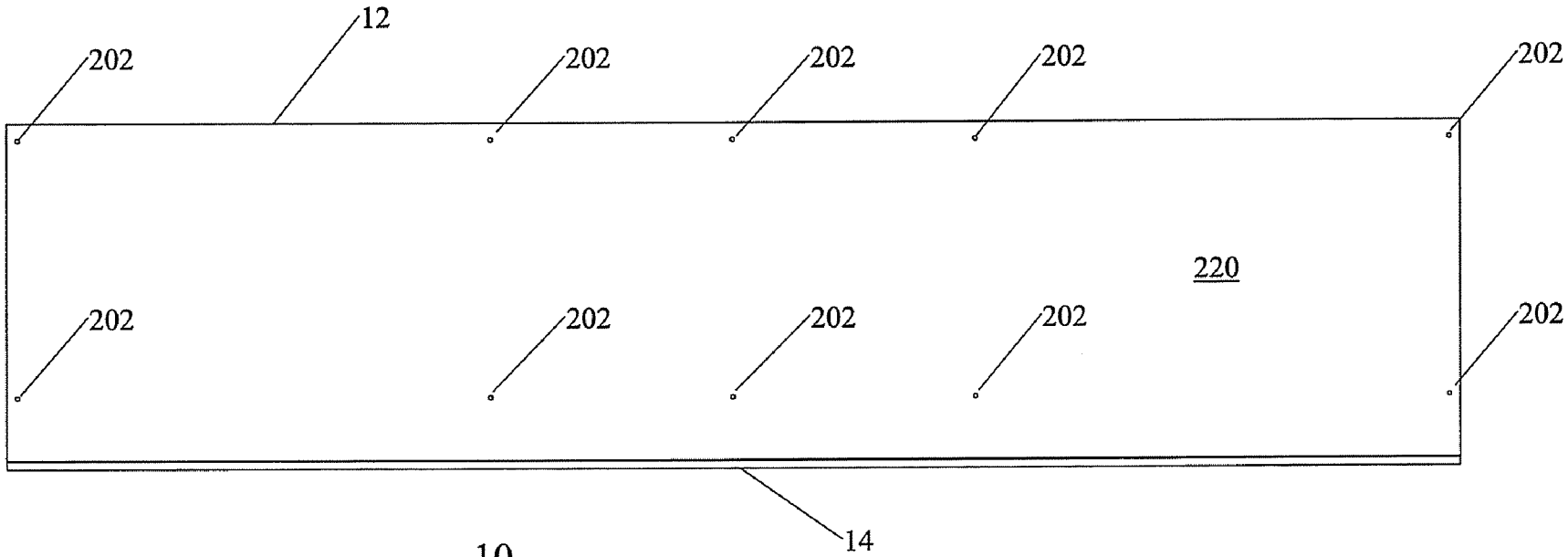
FIG. 1C is a top plan view of the intake vent of FIG. 1A.

FIG. 1B is a side view of the intake vent 10 showing the top section 200 fitted over the bottom section 100. As can be seen from the side view, the top wall 200 has at least one portion 208 that is arced or curved. This portion 208 converges with bottom section 100 at the uphill edge 12 of the intake vent 10. "Uphill" in "uphill edge" refers to the relative position of the edge when the intake vent is installed on an inclined roof. In embodiments, the top wall can be continuously curved from the downhill (or drip) edge 14 to the uphill edge 12 or only partially curved, as shown. The edge 12 defines the slope transition for roof shingles installed over the intake vent. In the illustrated embodiment, portion 206 is generally planar and parallel to the bottom wall 142 of the intake vent. By having a planar portion 206 and then a sloped portion 208, as opposed to a continuously sloped portion, the intake vent 10 maximizes the net free area for air to be ingested into the vent 10. The curved portion 208 maximizes (when compared to a fully (linear) tapered design) the net free ventilation area for air traveling through the vent 10 and allows for convergence with the bottom plane so that the shingles installed over the vent 10 can blend into the consecutive shingle courses above for an aesthetically acceptable installation. Additionally, the curved top portion 208 prevents any ponding of water near the uphill edge 12 of the vent 10.

FIG. 1B also illustrates various other features of the intake vent 10. For example, in some embodiments the intake vent 10 includes a downhill drip edge 14 forming a lip that helps to deter water traveling off of the roof that is pulled by gravity (when the intake vent 10 is installed on an inclined roof decking) over the top wall 220 from entering louvers 104 as a result of surface tension. The edge 14 also supports the starter course of shingles. In embodiments, the intake vent 10 also includes a tab 106 or series of tabs that can be used to properly align the intake vent 10 over a slot formed in the decking. More specifically, the tab 106 fits against the inside edge of the slot to properly align the vents 110 (FIG. 1E) formed through the bottom wall 142 of the intake vent 10 over the slot.

FIG. 1E is a partial bottom plan view of the intake vent 10. As can be seen in FIG. 1E, the bottom section 100 includes spaced vent openings 110 formed through the bottom wall 142, which is generally planar. Location tab 106 can also be seen in this bottom view. When in use, air flows in air intake louvers 104, through the cavity defined between the bottom wall 142 and top wall 220, and out the vents 110, which are aligned with the opening or slot cut into the roof decking. Reference numbers 108 identify optional openings that are not used as vents but rather are provided for weight reduction in some embodiments.

Figure 1D:
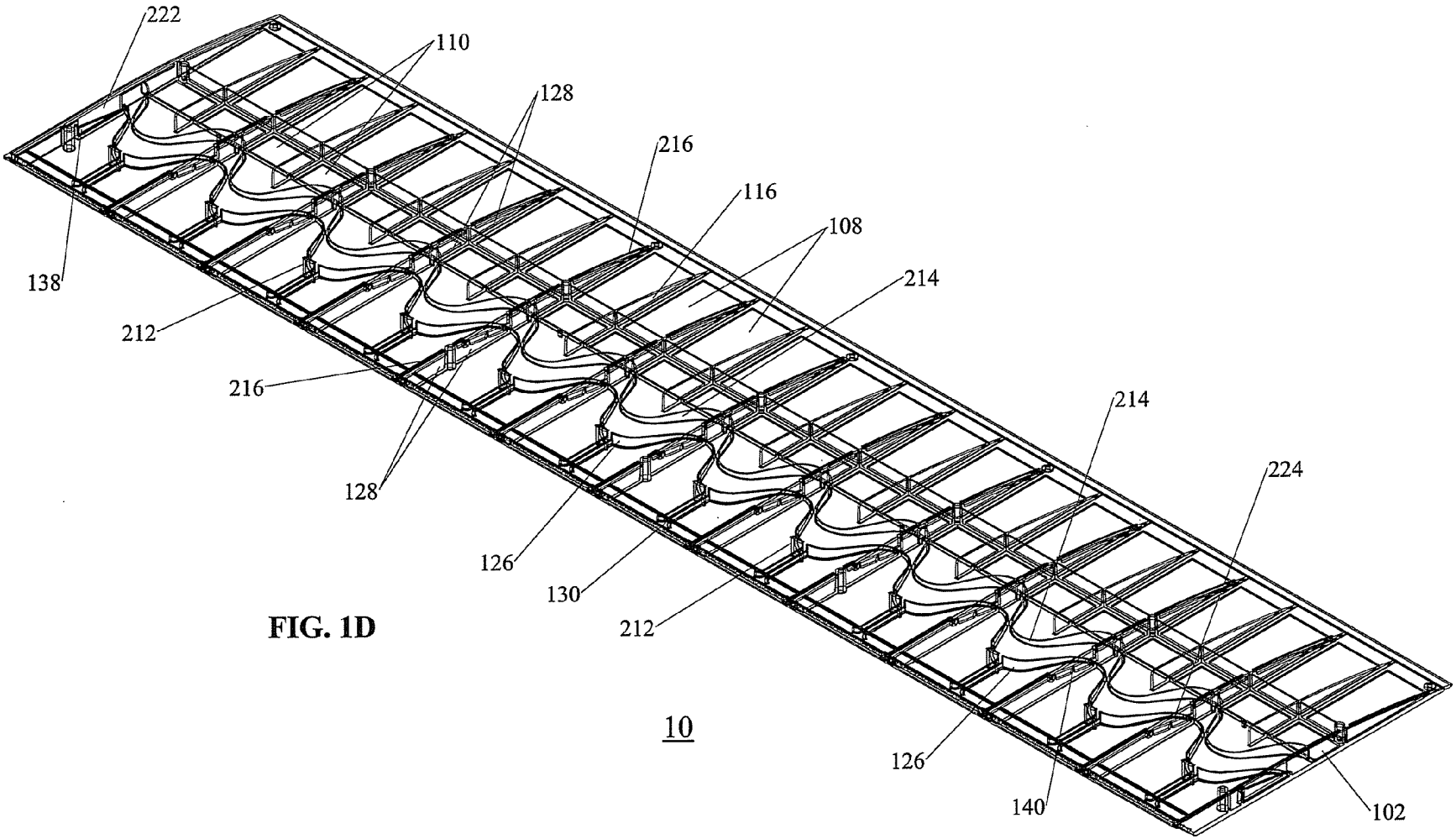
FIG. 1D is a perspective view of the intake vent of FIG. 1A with the top surface hidden to show the arrangement of internal components therein.
Figure 1E:
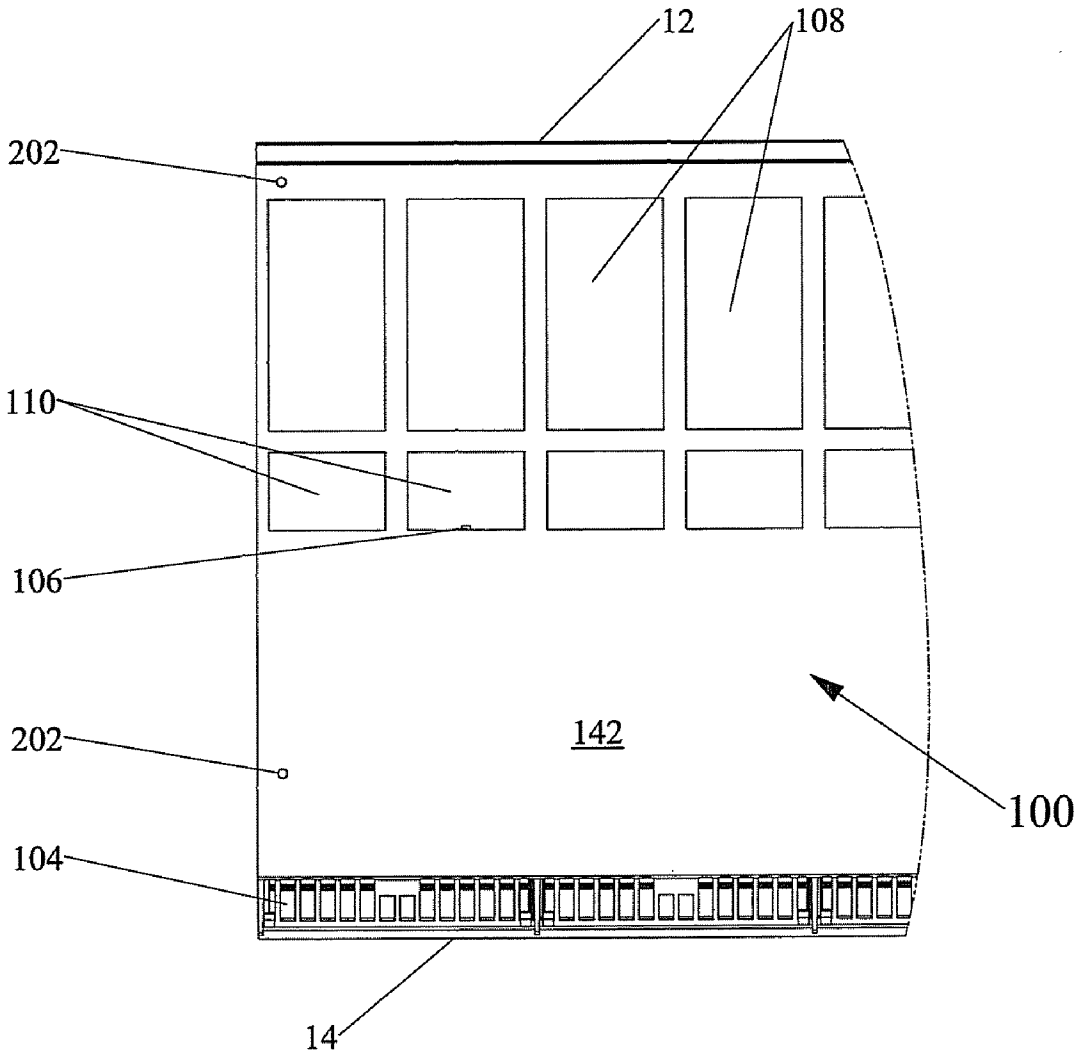
FIG. 1E is a bottom plan view of a portion of the intake vent of FIG. 1A.
Figure 1F:
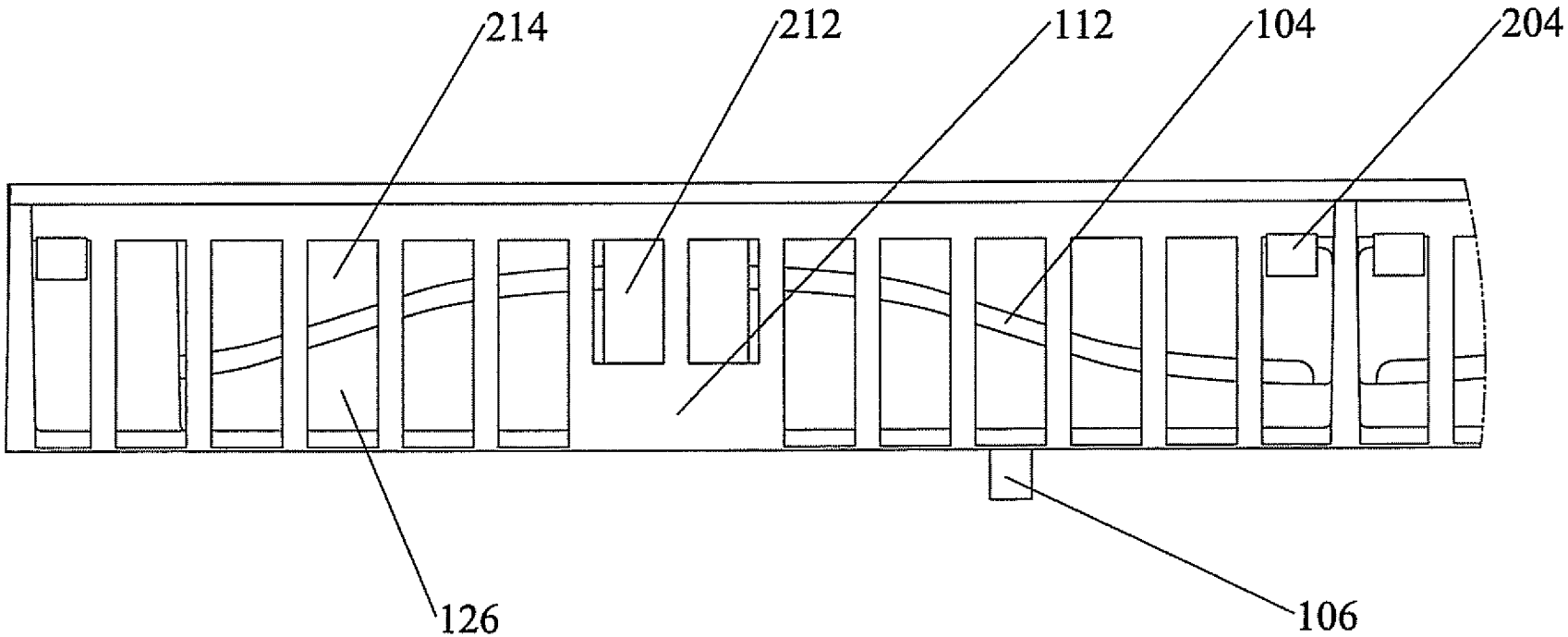
FIG. 1F is a front plan view of a portion of the intake vent of FIG. 1A.

FIG. 1F is a partial front view of the intake vent 10 showing the louvers 104 in more detail. In one embodiment, the louvers 104 include wind blocks 112, which protect or divert air away from internal drainage channels 130 (discussed in more detail below). The wind blocks 112 promote drainage by creating an air dam that prevents wind from driving into the drainage channels 130 and assists with drainage from the channels 130 based on pressure conditions associated with wind flowing around the wind blocks 112.

Figure 2A:
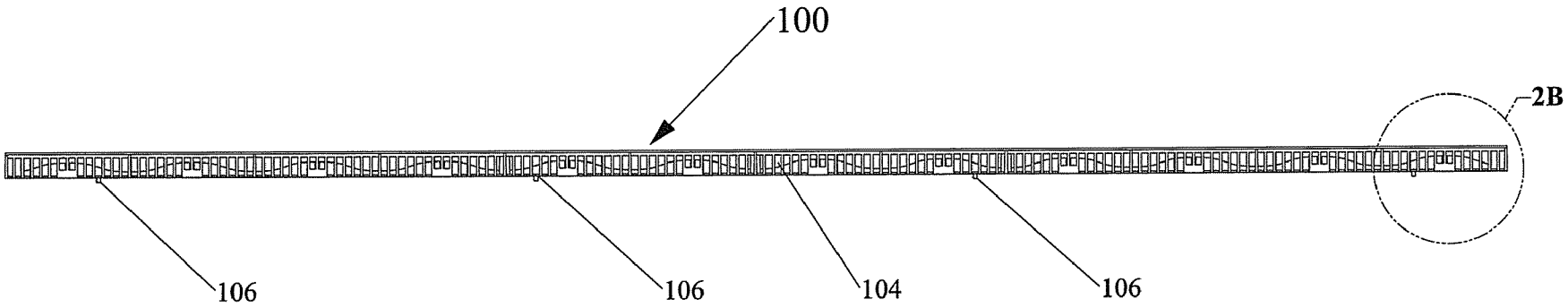
FIG. 2A is a front plan view of a bottom section of the intake vent of FIG. 1A.
Figure 2B:
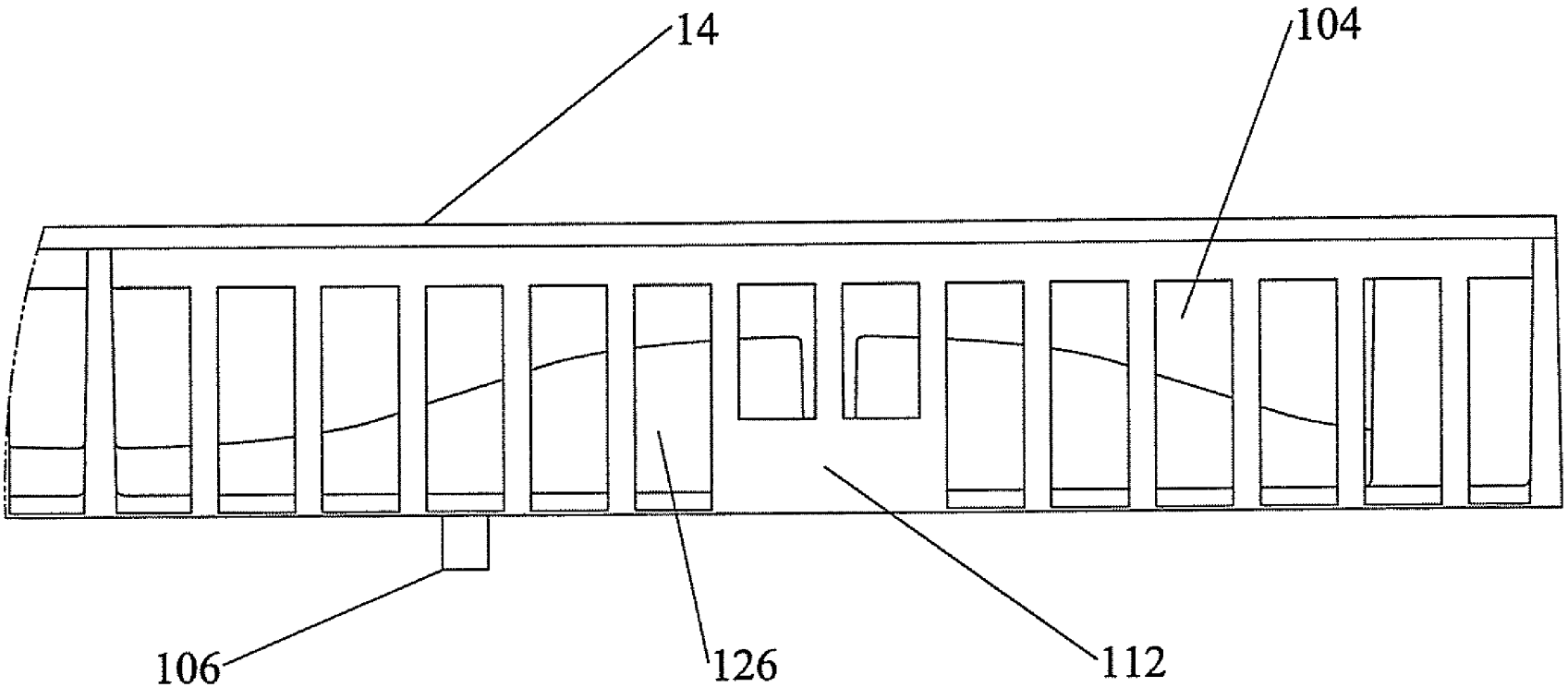
FIG. 2B is an enlarged front plan view of a portion of the bottom section of FIG. 2A.

FIGS. 2A-2E illustrate in more detail the features of the bottom section 100 of the intake vent 10. FIG. 2A is a front view of the bottom section 100 and FIG. 2B is an enlarged front view of a portion of the front of bottom section 100 showing louvers 104, tab 106, wind block 112 and protective drip edge 14.

Figure 2C:
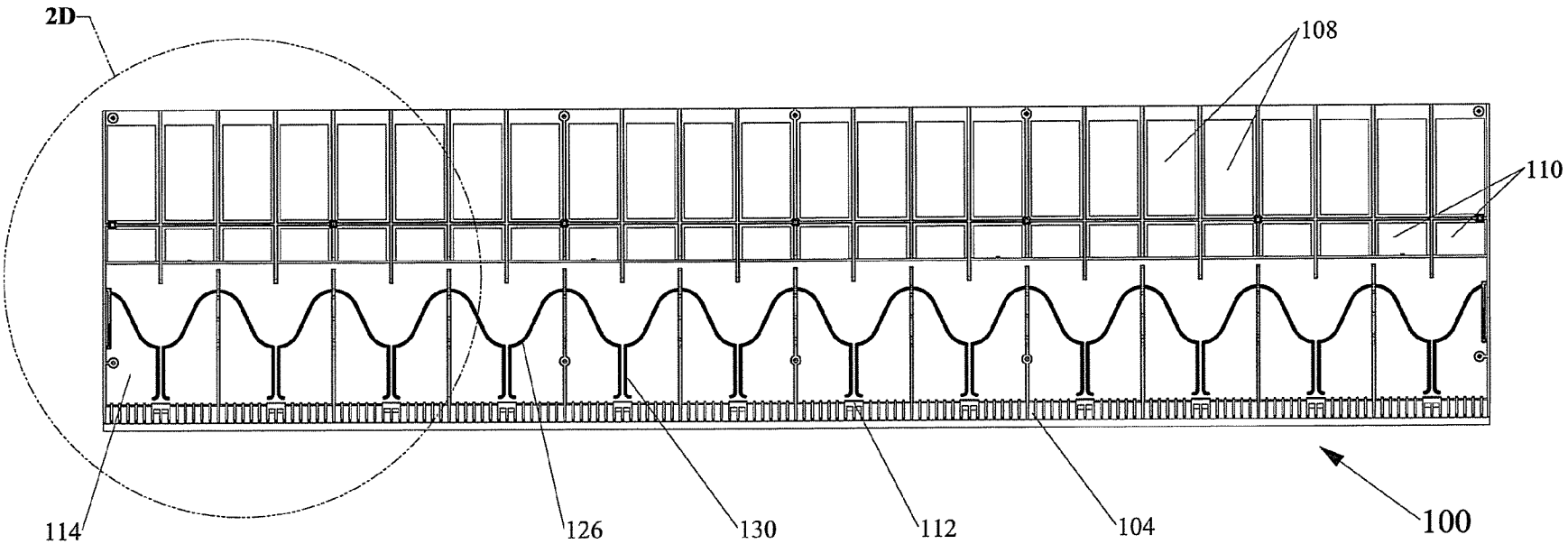
FIG. 2C is a top plan view of the bottom section of FIG. 2A.
Figure 2D:
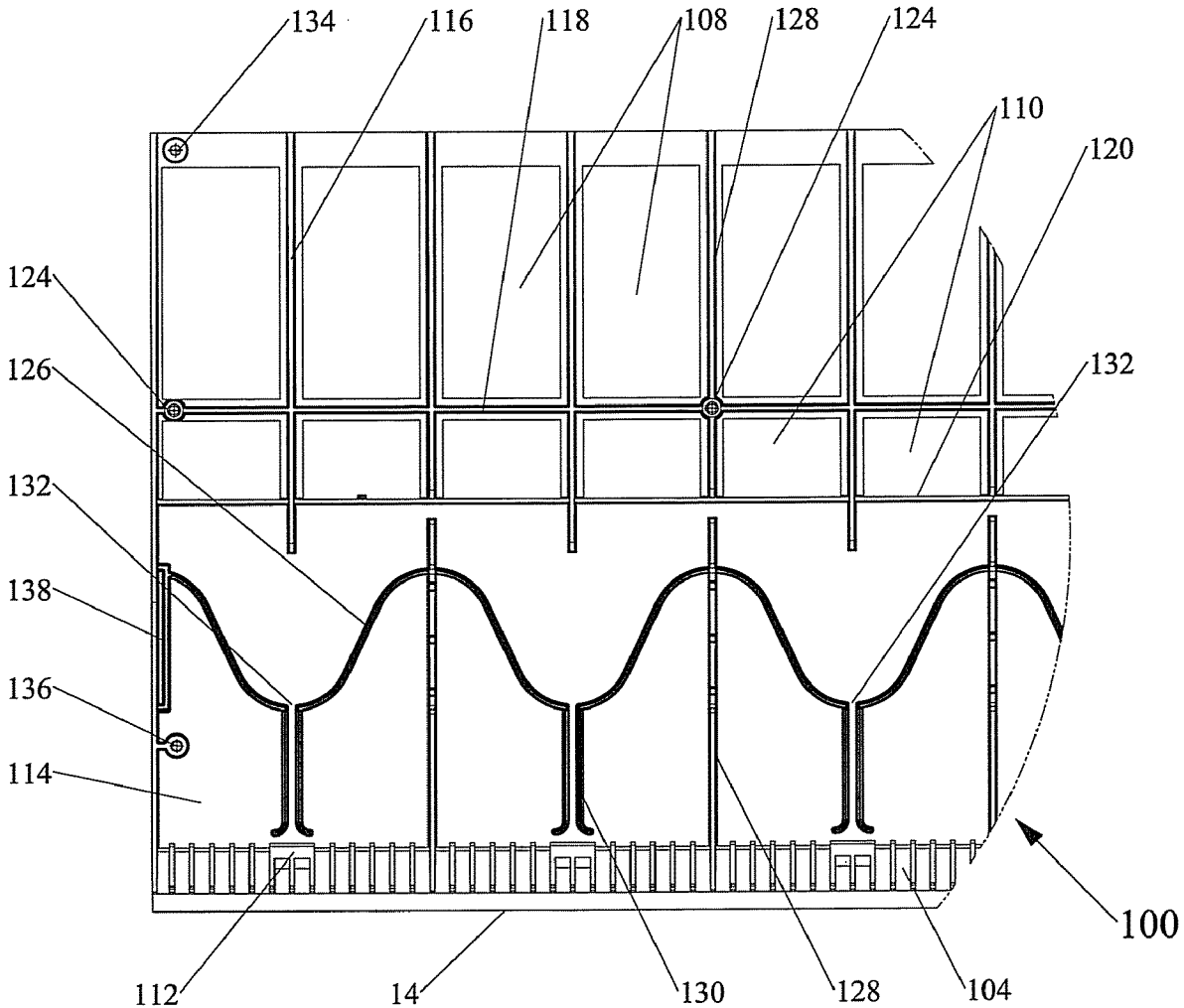
FIG. 2D is an enlarged top plan view of a portion of the bottom section of FIG. 2A.
Figure 2E:
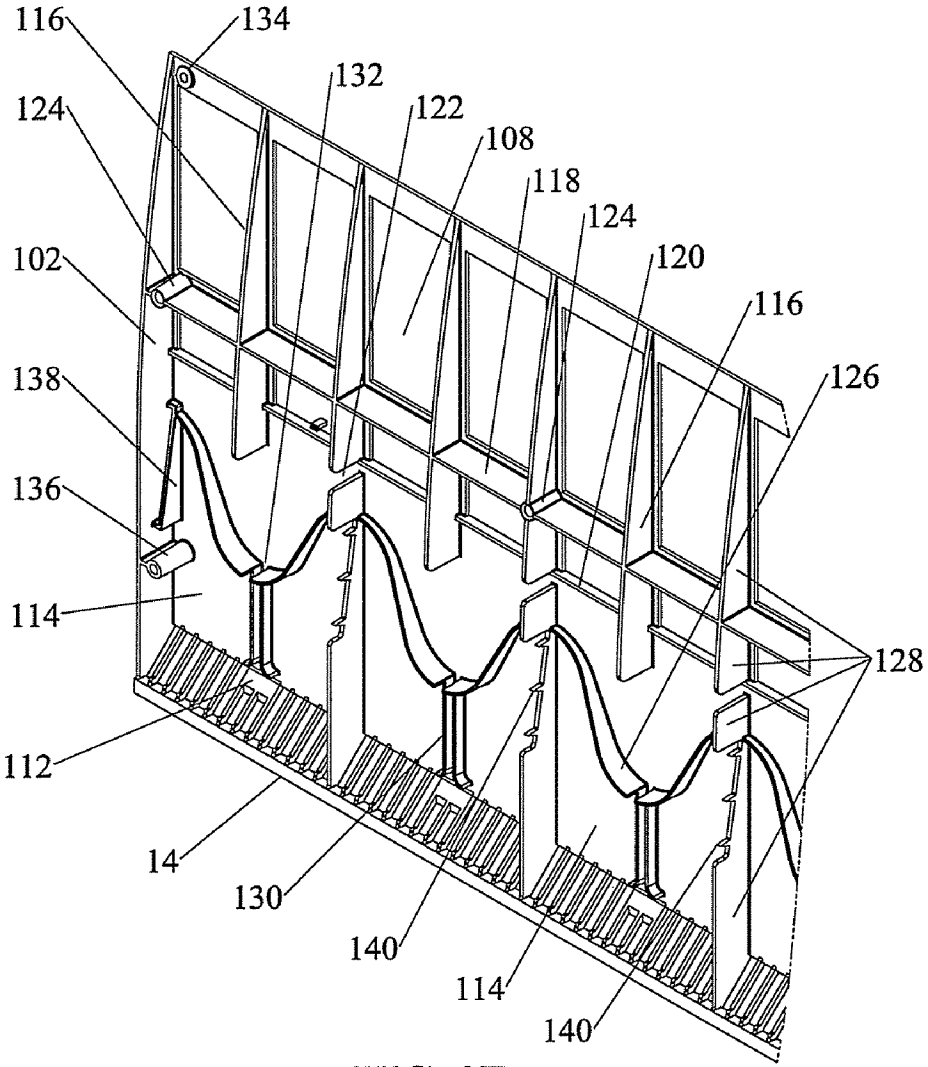
FIG. 2E is a partial perspective view of a portion of the bottom section of FIG. 2A.

FIG. 2C is a top plan view of the bottom section 100 showing internal features of the intake vent 10 provided by the bottom section 100. FIG. 2D is an enlarged view of a portion of FIG. 2C. FIG. 2E is a perspective view of a portion of the bottom section 100. As shown in the figures, the bottom section 100 has a primary drainage surface 114 located inward of the louvers 104. The surface 114 provides a drainage plane between the air intake louvers 104 and the internal baffles (discussed below) and serves to protect the roof deck below from any moisture that enters the vent. The bottom section 100 also includes a first wind baffle 126 that protrudes from the bottom wall 142 and extends across the bottom section 100 between the side walls 102. The first wind baffle 126 includes openings 132 for drainage of any water that makes it past the wind baffle 126. The drainage openings 132 are in communication with drainage channels 130 that drain water to the louvers. The drainage channels 130 are protected by wind blocks 112 as discussed above, which facilitate drainage from the channels 130. In embodiments, the drainage channels 130 include parallel short ribs that protrude from the primary drainage surface 114 and direct bulk water from the first wind baffle 126 to the air intake louvers 104 for drainage from the intake vent 10.

Various other features of the bottom section 100 are also shown in these drawings. In embodiments, the bottom section 100 includes various support ribs for providing stability to the assembled product, such as continuous intermediate curved support ribs 116 positioned 4.0" on center adjacent the vents 110 and terminate just below the vents 110, lateral support ribs 118 perpendicular to the intermediate support ribs 116, and internal support ribs 128, which begin with the end plugs 112 and are also spaced 4.0" on center. These internal support ribs 128 extend from (or proximate to) edge 12 to (or proximate to) louvers 104 and have lateral drainage gaps 122 (labeled in FIG. 2E) formed therein. Support ribs 116 provide reinforcement to the top section 200 from the uphill edge 12 to just below the vent slot location that is cut in the roof deck, i.e., for the curved portion 208 of the top wall 220. Lateral continuous support ribs 118 are positioned between friction pin bosses 124 and run the entire length of the bottom section 100. These ribs 118 help support the top wall 220 of the top section 200 and help prevent lateral movement and collapse of the perpendicular support ribs 116 and 128. Internal support ribs 128 also provide internal support to the top wall 220 of the top section 200 from the downhill/drip edge 14 to the uphill edge 12, i.e., for the planar portion 206 and curved portion 208 of the top wall 220, and also incorporate features discussed below for locating and retaining a filter, as well as facilitating lateral water drainage.

As can be seen in FIGS. 2C-2E, the bottom section 100 includes a primary or first wind baffle 126 that extends between the side walls 102 of the intake vent 10. In embodiments, the wind baffle 126 undulates in two planes both up and down (i.e., in the distance it protrudes or extends from the surface 114 of the bottom section 100) and back and forth (i.e., in the distance it is from the edges 12, 14 of the intake vent or other reference point). In embodiments, the first wind baffle 126 has a sinusoidal shape with a top edge that is inclined so that the sections of the curve nearest the downhill side of the vent (i.e., near air intake louvers 104 and downhill edge 14) are taller than those sections nearest the airflow exit vents 110 (i.e., nearer uphill edge 12). The baffle 126 provides a second line of defense for weather infiltration, with the ribs of the louvers 104 providing the first line of defense against weather and insect infiltration, by deflecting air up towards the top wall 220 and back towards the internal support ribs and the secondary wind baffle 214 of the top section 200 (discussed below). In the event that water backs up into the intake vent 10, the inclined design allows water to spill over the uphill sections (i.e., lower points) of the baffle 126.

In embodiments, the bottom section 100 includes nail bosses 134 and 136 that form part of the nail holes 202 described above. In embodiments, nail bosses 136 are positioned near the intake louvers 104 for pre-fastening the intake vent 10 to the roof decking and are located 16" on center and 24" on center for nailing into framing rafters of the roof. Nail bosses 134 are positioned near the uphill edge 12 and also located 16" on center and 24" on center for nailing into the framing rafters on the roof. Nail bosses 134 can have angled top surfaces that support the top section 200 during pre-fastening of the intake vent.

The bottom section 100 may also include friction pin bosses 124 located along ribs 118 and spaced across the length of the bottom section 100. The friction pin bosses 124 are closed end friction bosses that accept fiction pins located at the top section 200 in order to secure the top section 200 to the bottom section 100 during assembly.

The bottom section 100 also includes rectangular filter capture bosses 138 at either end of the bottom section 100 proximate the side walls 102. These bosses are used to capture the ends of an internal filter 300 (FIG. 1G) in cooperation with mating filter capture blades 222 (FIG. 3E) on the underside of the top section 200. The bottom section 100 can also include barbs 140, such as three barbs 140 per support rib 128 as shown in FIG. 2E. In embodiments, these barbs 140 are pointed, teeth-like extensions on the inclined edges of the ribs 128 that help retain the filter once the product is assembled.

In embodiments, the bottom section 100 also includes a water dam wall 120. Water dam wall 120 is essentially a short rib protruding from the surface of the bottom section 100 that runs the length of the vent section 100 in front of the airflow exit slots 110. This dam 120 helps to prevent or deter any water that travels beyond the wind baffles from entering the attic space via the vents 110. Lateral drainage gaps 122 are also provided in support ribs 128 before the water dam wall 120 to allow water to drain laterally towards channels 130, such as in the event that sections of the vent in between internal support ribs 128 become blocked and do not allow for the drainage of bulk water directly toward the intake louvers 104.

Figure 3A:
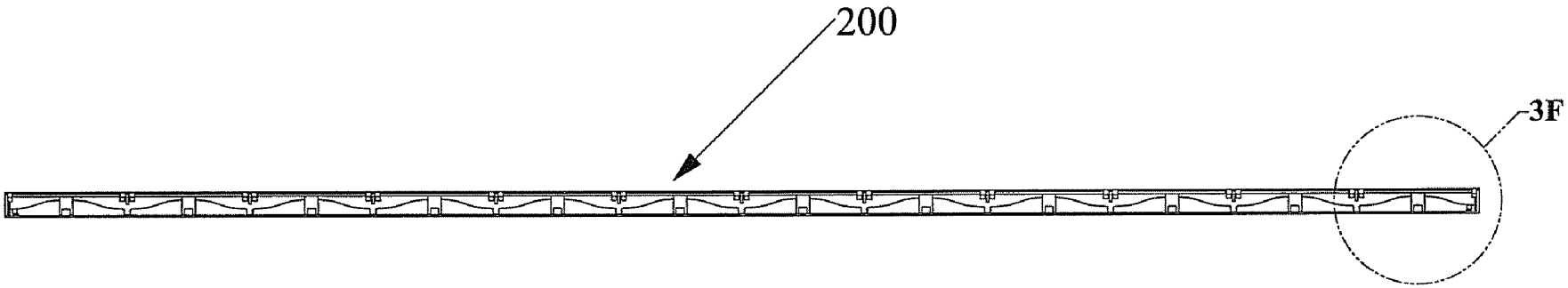
FIG. 3A is a front plan view of a top section of the intake vent of FIG. 1A.
Figure 3B:
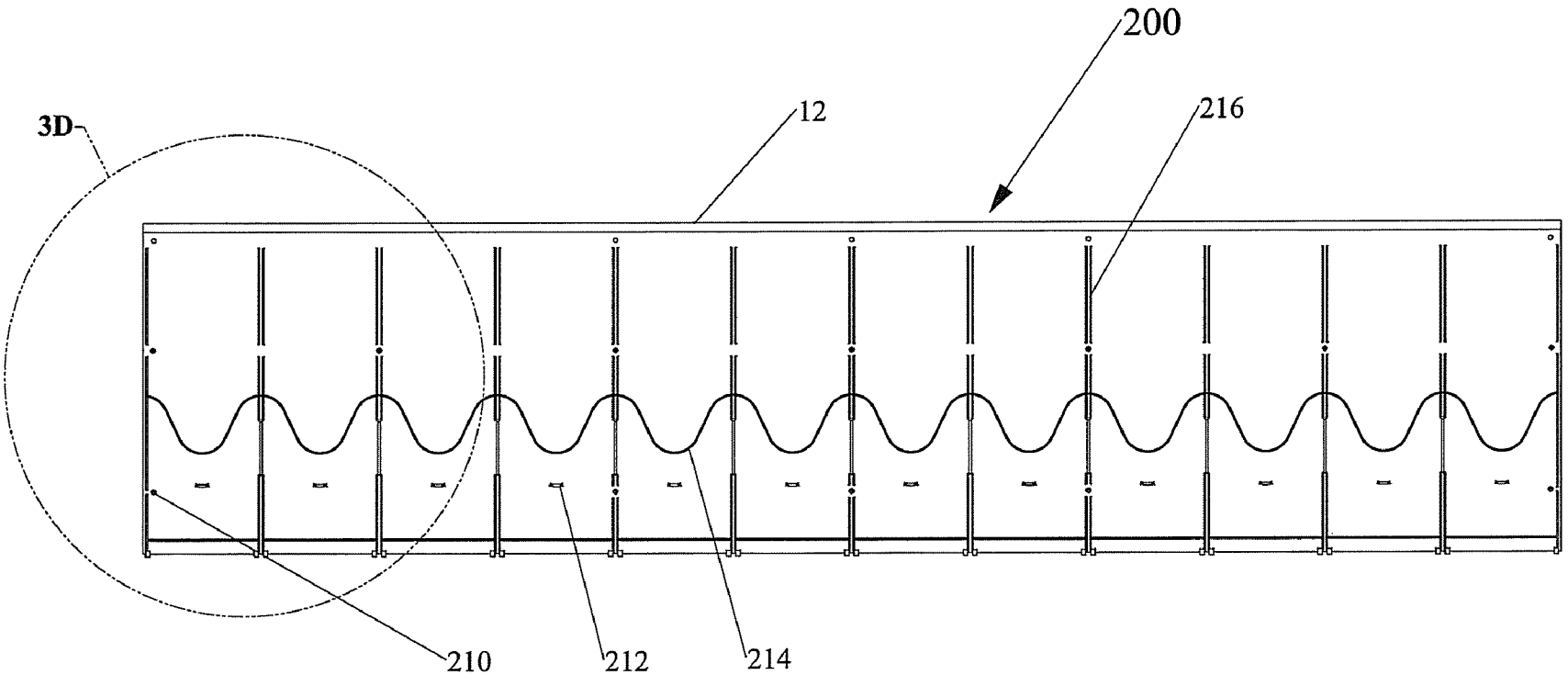
FIG. 3B is a bottom plan view of the top section of FIG. 3A.
Figure 3C:
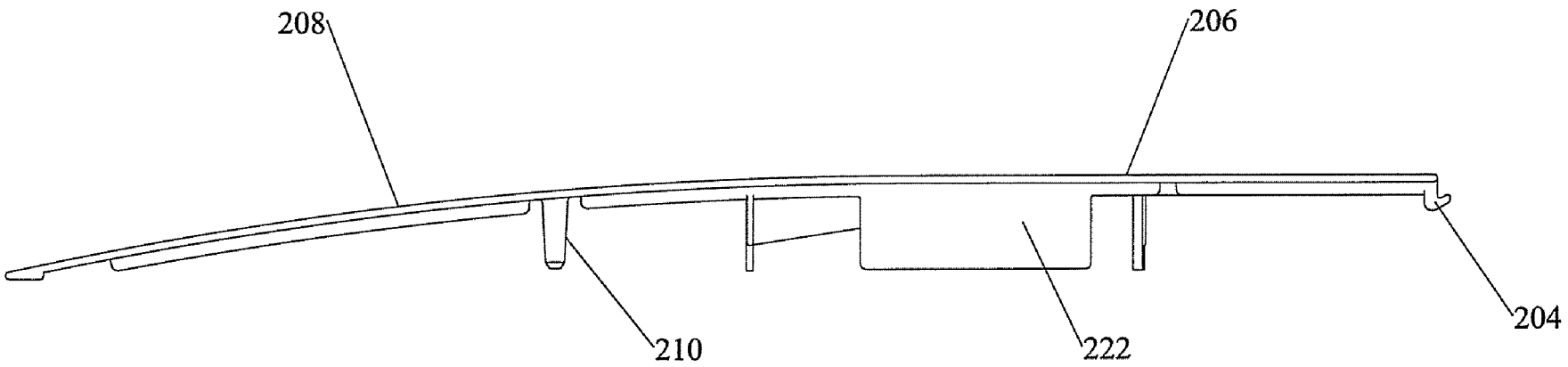
FIG. 3C is a side view of the top section of FIG. 3A.
Figure 3D:
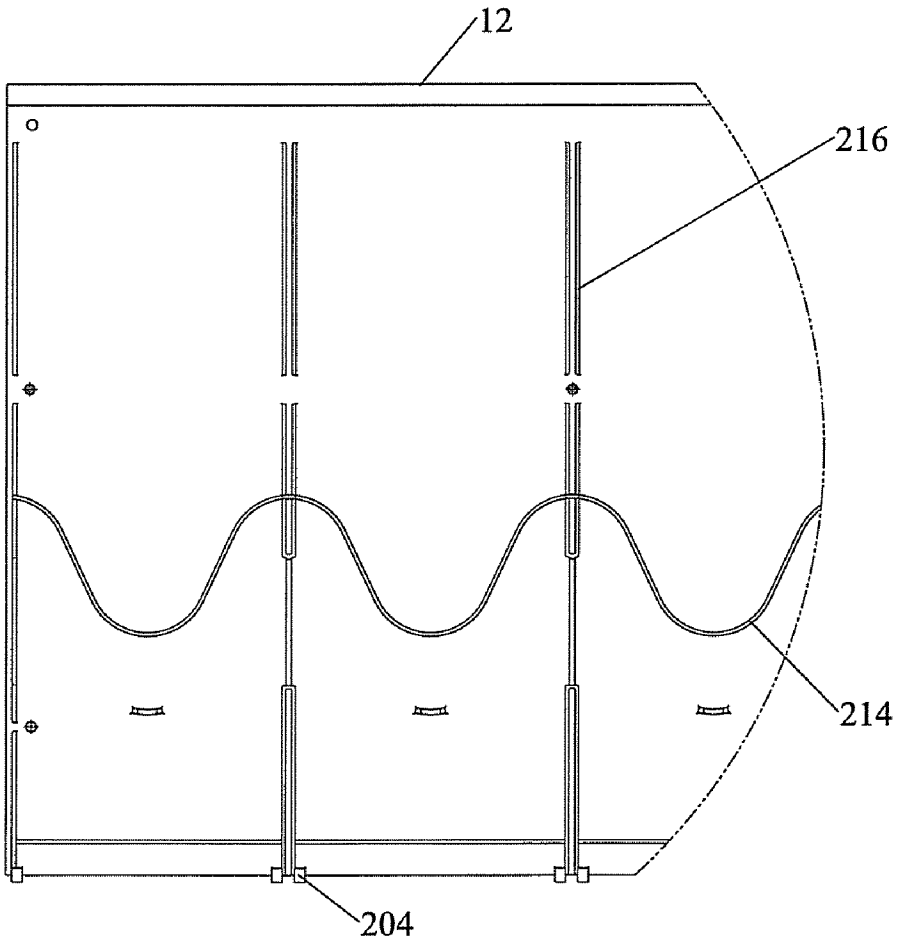
FIG. 3D is an enlarged partial bottom plan view of the top section of FIG. 3A.
Figure 3E:
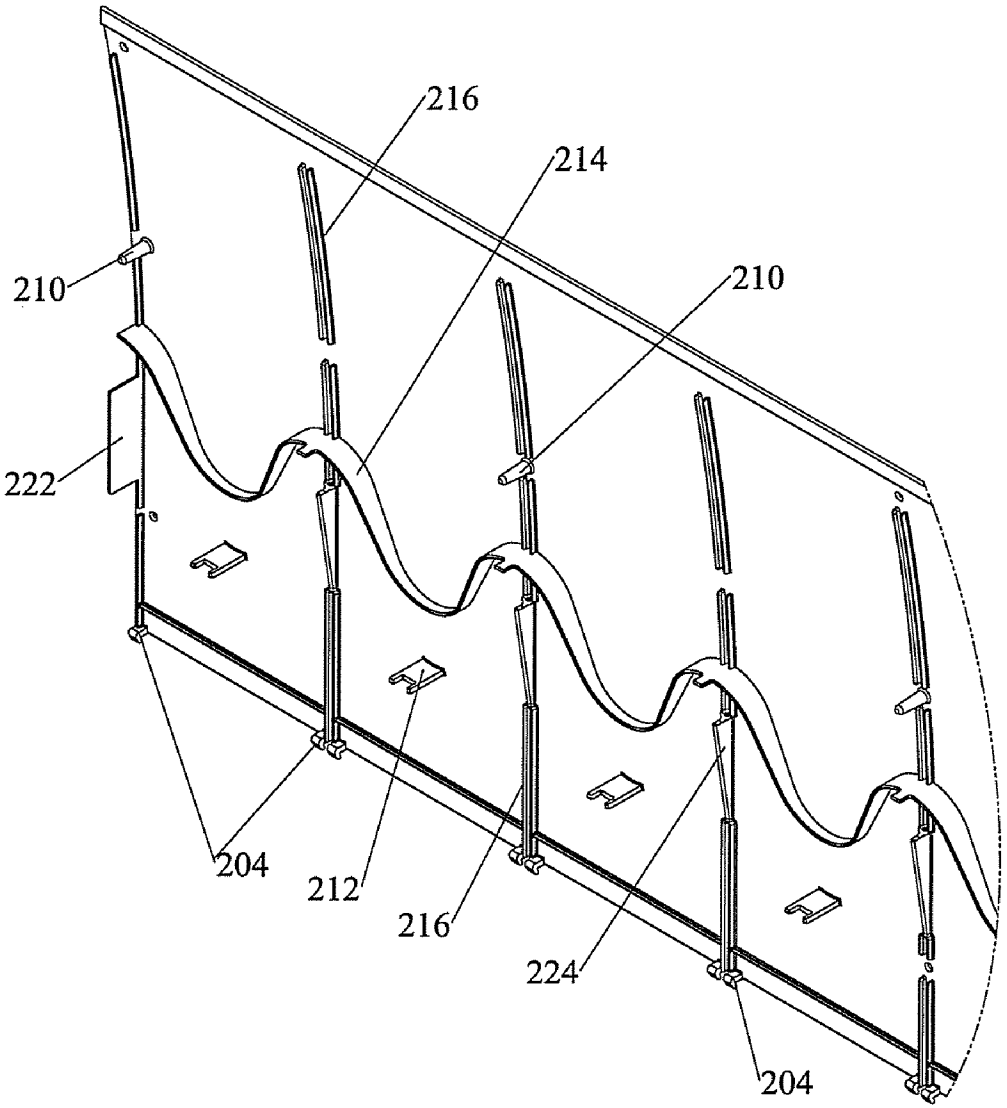
FIG. 3E is a partial perspective view of the top section of FIG. 3A.
Figure 3F:
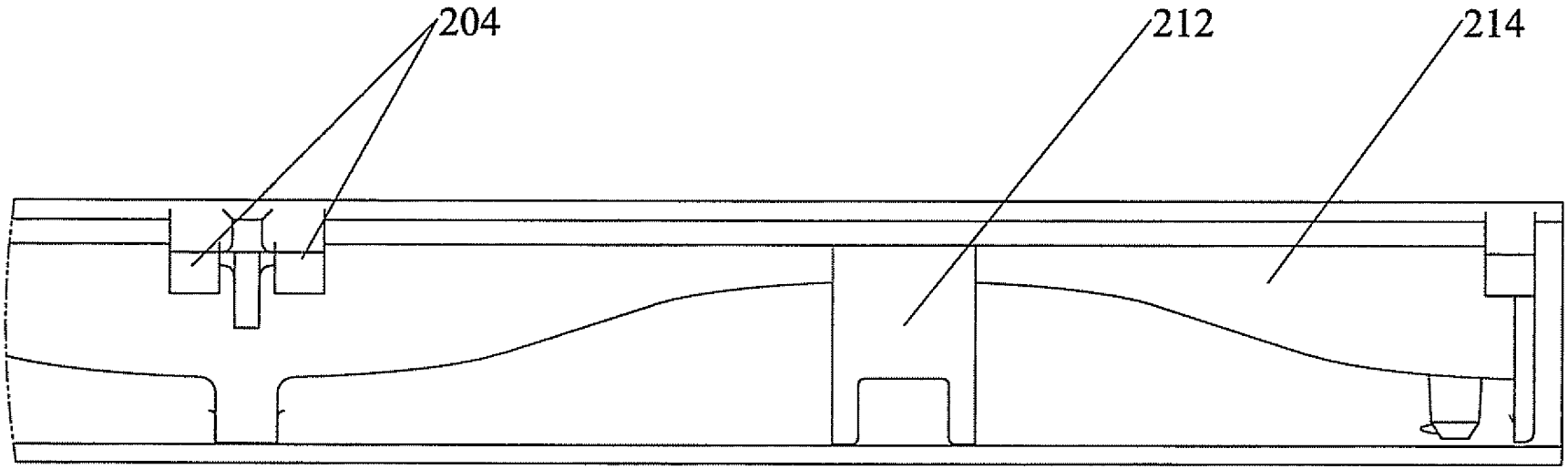
FIG. 3F is a front plan view of a portion of the top section of FIG. 3F.

FIGS. 3A-3F illustrate in more detail the features of the top section 200 of the intake vent 10. FIG. 3A is a front view of the top section 200 and FIG. 3B is a bottom plan view of the top section 200. FIG. 3D is an enlarged partial bottom plan view, FIG. 3F is an enlarged partial front view, and FIG. 3E is an enlarged partial perspective view of respective portions of the top section 200. FIG. 3C is a side view of the top section 200.

In embodiments, the top section 200 includes wind diverters 212 depending from the bottom surface of the top section 200. These wind diverters 212 align with the drainage channels 130 (as shown in FIG. 1D) when the top and bottom sections 200, 100 are mated. The wind diverters 212 prevent wind from driving through the drainage gaps 132 in the first wind baffle 126. As shown, the wind diverters are narrow curved walls that incorporate openings to straddle the ribs of the drainage channels 130 that protrude from the bottom section's primary drainage surface 114. These wind diverters 212 also provide support to the top wall 220 of the intake vent 10 by transferring compressive loads to the roof deck.

The top section 200 includes a second wind baffle 214 that depends from its bottom surface and extends across the length of the top section 200. Like primary wind baffle 126, in embodiments the wind baffle 126 undulates in two phases, both in height (i.e., distance from the underside of wall 220) and along its length (i.e., in its distance from edges 12, 14 (or other reference point)), such as in a sinusoidal path. The second wind baffle 214 undulates along its length in sync, i.e., in phase with the first wind baffle 126 such that it runs parallel with the first baffle 126. However, the second wind baffle 214 undulates out-of-phase, such as by 90°, with respect to its height or distance from its surface. The variation of the height of the sinusoidal internal baffles maintains the maximum net free ventilation area through the vent and diverts wind carried moisture to more protected areas. The second wind baffle 214 provides an additional line of defense against weather infiltration by deflecting air down and back towards the taller portion of the curved baffle 214 (i.e., the portions of baffle 214 that extend from the top section 200 to the surface 114 of the bottom section 100. The baffles 126 and 214 cooperate to force water and snow to drop out of the air flow and drain out of the intake vent 10, using one of the several drainage features discussed herein, thereby deterring snow or water from entering vents 110 and thus from entering the interior of the structure to which the vent 10 is secured.

The top section 200 also includes a plurality of spaced friction pins 210 for mating with the friction pin bosses of the lower section 100. These pins 210 protrude from the underside of the top section 200 and hold the top and bottom sections 200, 100 together when press fit.

Figure 1G:
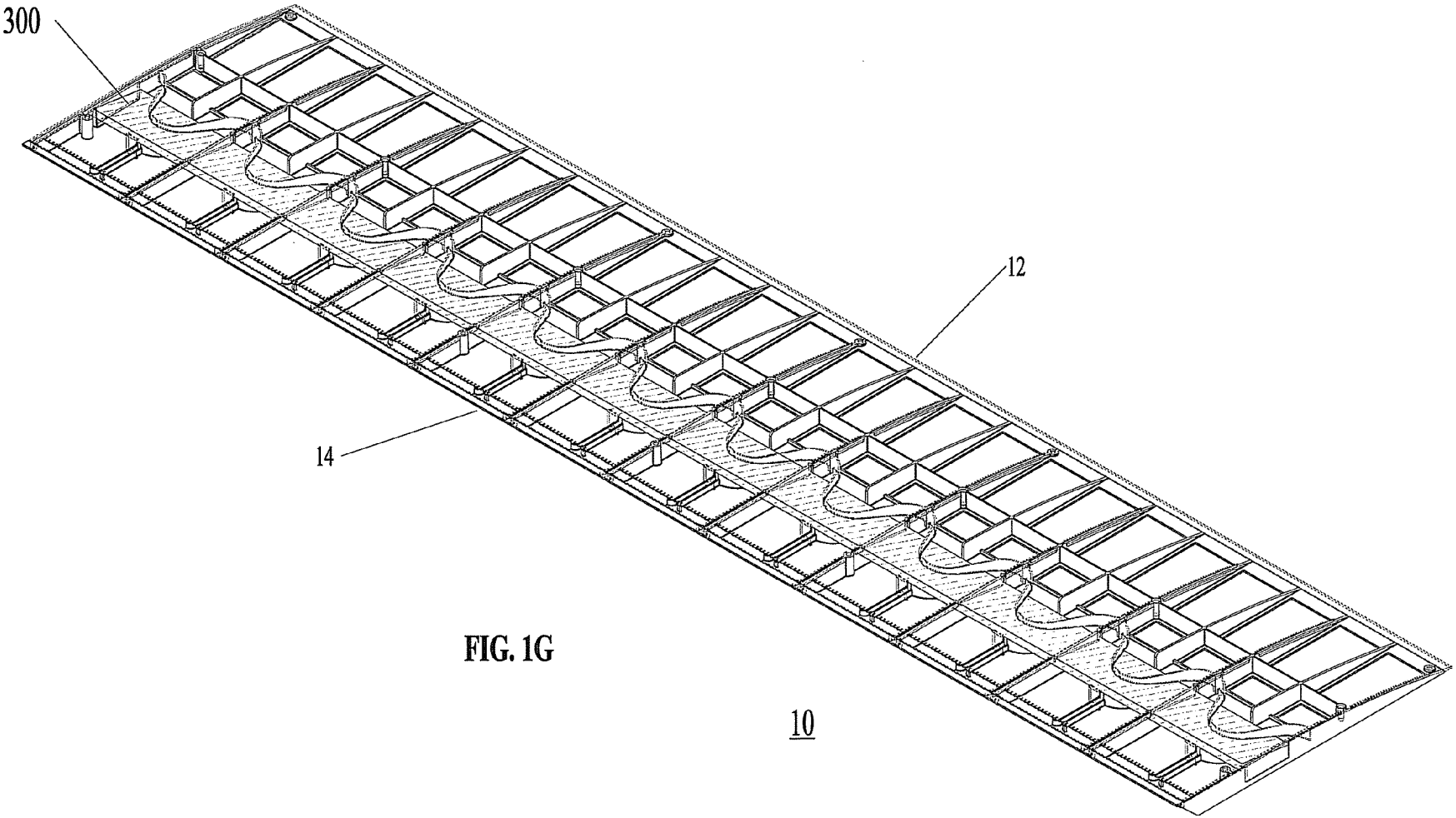
FIG. 1G is a perspective view of the intake vent of FIG. 1A with the top surface hidden to show the integral internal filter.

A pair of rectangular blades 222 depend from the underside of the top section 200 proximate the side edges of the top section and are positioned to mate with filter capture bosses 138 and the side walls 102 of the bottom section 100. These blades 222 capture the ends of the internal filter (FIG. 1G) when inserted into the mating filter capture bosses 138 of the bottom section 100. In embodiments, the top section 200 also includes angled filter retention ribs 224. These ribs 224 have inclined edges that are parallel with the inclined edges of the internal support ribs 128 at the barbs 140 of the bottom section 200. These retention ribs 224 are positioned to help retain the internal filter against the barbs 140 once the bottom and top sections 100, 200 are assembled together to form the intake vent 10. As shown in FIG. 1G, the filter 300 extends across the vent below part of baffle 214 and over baffle 126. The filter is captured at an incline and slopes downward from the louver side of the vent to the uphill edge side of the vent.

In embodiments, a filter is captured between the top and bottom sections 200, 100 as described above. In preferred embodiments, the filter is approximately two inches wide and runs the length of the vent 10 between the first and second wind baffles 126, 214. This filter provides a third line of defense for weather infiltration and the second line of defense for insect infiltration. In embodiments, the filter is a glass non-woven filter or polymeric filter. One exemplary filter is a fiberglass mesh filter as shown in, for example, U.S. Pat. No. 6,482,084, the entirety of which is hereby incorporated by reference herein.

In the illustrated embodiment, the top section 200 also includes a plurality of capture support ribs 216. These short ribs protrude off of the underside of the top section 200 and capture the tops of the bottom section's internal support ribs 128. These ribs 216 help prevent the lateral movement and collapse of the internal support ribs when the vent 10 is subjected to compressive load on the top surface thereof.

As best shown in FIGS. 1F, 3E and 3F, the top section 200 also includes a series of attachment hooks 204 positioned at the downhill edge 14 of the intake vent 10. These hooks 204 help retain the top section 200 to the bottom section 100 at the air intake louvers 104.

In one embodiment, the top section 200 is produced such that the curved profile has a shorter radius (but same arc length) than when it is assembled with the bottom section 100. Once the friction pins 210 of the top section 200 are pressed into the mating bosses 124 of the bottom section 100, the uphill sides of the top and bottom sections are held together in tension. In other words, the top curvature increases once the pins are inserted so that the top section compresses on the bottom section. The assembly causes the uphill edge 12 of the top component 200 to rotate up and back approximately ¼" once mated with the bottom component 100.

FIG. 1D is a perspective view of the intake vent of FIG. 1A with the top surface hidden to show the arrangement and interaction of internal components thereof from the bottom and top sections 100, 200. For example, FIG. 1D shows the spacing relationship between the first and second wind baffles 126, 214, the wind blocks 212 straddling the drainage channels 130, the capture ribs 216 straddling the ribs 128, and the angled ribs 224 sitting on barbs 140.

In some embodiments, the intake vents are manufactured in lengths of about 48" with widths of about a foot or less, such as 11.5" The thickness of the panel, i.e., the distance from the top surface to the bottom surface, measured at the flat, non-tapered portion 206 is preferably an inch or less, such as 0.8". The curved portion of the top of the vent 10 as shown in the figures preferably makes up approximately 50-70%, and more preferably about 60%, of the overall width (defined between the uphill edge 12 and the downhill edge 14) of the vent 10.

The preferred materials for the vent can include, but are not limited to, thermoplastics such as polypropylene, polyethylene, etc. The preferred manufacturing process is, but need not be, plastic injection molding.

Figure 4:
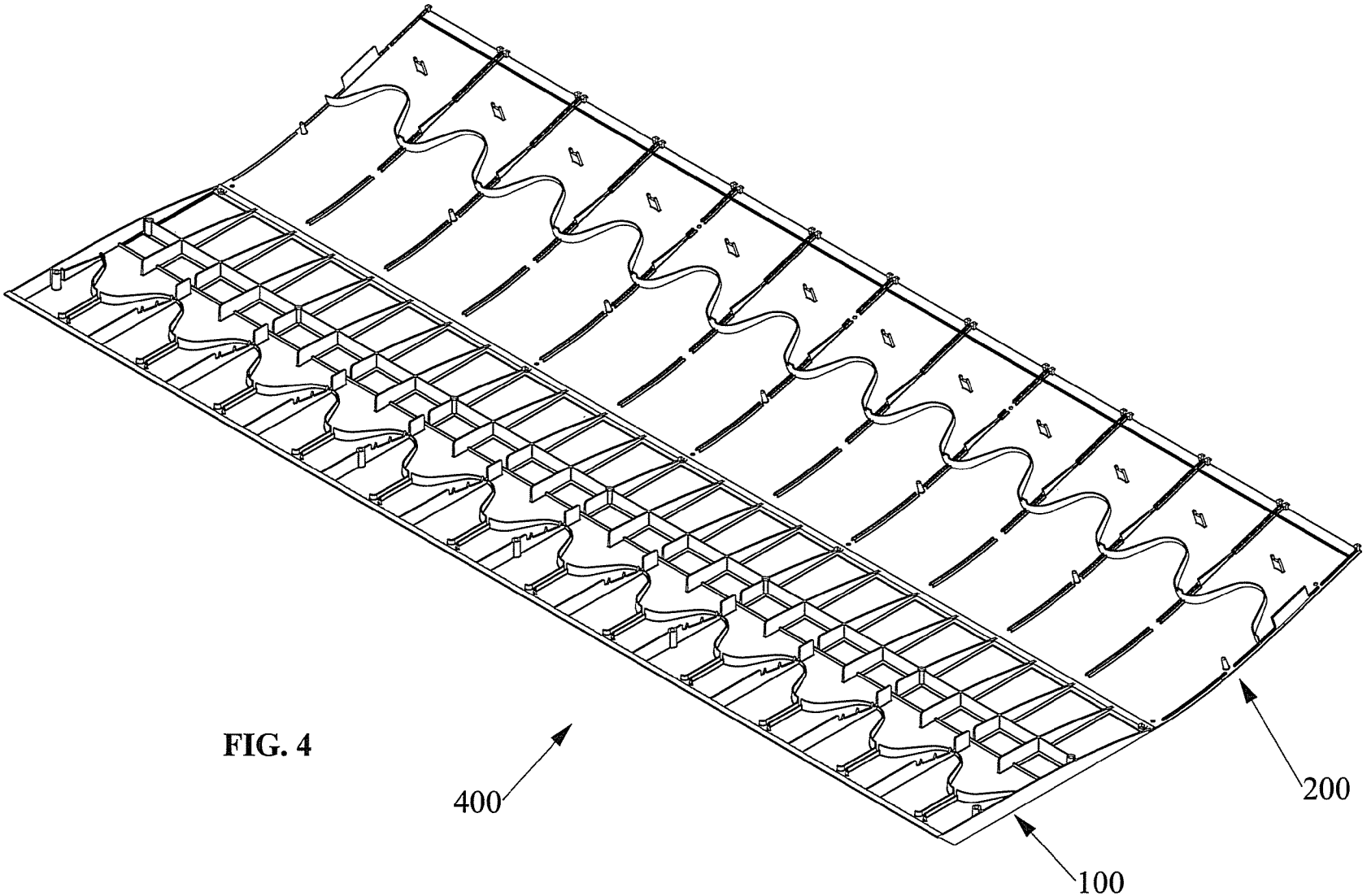
FIG. 4 illustrates a hinged embodiment of the intake vent.

As described herein a roof mounted, shingle-over attic ventilation device is designed to ingest air into the attic space from the edge of the roof. The vent 10 incorporates a curved top that allows for maximization of the net free ventilation area through the vent, minimization of product height, and convergence with the bottom plane to blend into the roof at the uphill edge of the vent. In embodiments, interior features of the intake vent include a series of support ribs, nail or fastener supports, wind and water baffling system, drainage system, and weather filter which may be bonded, mechanically fastened, or captured. Exterior features include an integrated drip edge, integrated end plugs (i.e., integrated side walls), and vent locating means. The construction of the intake vent is accomplished using either a hinged design (shown as intake vent 400 in FIG. 4) or a multi-piece design (FIGS. 1-3) that is assembled with mechanical features such as hooks, friction pins, spring fit features, etc. Because of pressure conditions associated with wind flowing over a pitched roof, thermal buoyancy in the attic, powered attic ventilation systems, etc., air is ingested into the vent, passes through the vent, and enters the attic space via a horizontal slot cut into the roof deck while leaving behind weather elements.

In the illustrated embodiments, the intake vent 10 includes at least four drainage means, including: (1) a primary drainage surface 114 located between the louvers 104 and first baffle 126 for draining water captured on the louver side of the first baffle 126; (2) the combination of gaps 132 in the first baffle and drainage channels 130 for draining water that gets past the first baffle 126; (3) lateral drainage gaps 122 for allowing water to drain laterally towards an adjacent channel 130 if backed up; and (4) spilling over the first baffle 126 if water levels rise, such as if a channel 130 is clogged. In the illustrated embodiments, the intake vent 10 also includes at least seven lines of defense against weather and/or insect infiltration, including: (1) the ribs of the louvers 104; (2) the wind blocks 112 for the channels 130 built into the louvers 104; (3) the first baffle 126; (4) the wind diverters 212 that protect the drainage openings 132 in the first baffle 126; (5) the filter captured in the intake vent (if used); (6) the second baffle 214; and (7) the water dam 120.

Because of pressure conditions that can result in the ingestion of airflow into the vent, as described above, air enters the vent in the louvers 104 shown in FIG. 1A and FIG. 1F. The wind block 112 diverts air away from the drainage channels 130 shown in FIG. 2D. Air approaches the first wind baffle 126 and is directed away from the drainage gap 132 because of the wind diverter 212 as shown in FIG. 1D. Because of the pressure conditions internal to the intake vent 10, air is directed up towards the underside of the top component 200 and back towards the uphill curves of the first wind baffle 126. Air is forced through the filter media 300 in FIG. 1G, which is on an inclined plane between the first baffle 126 and the second baffle 214 of FIG. 1D. The second baffle 214 forces the air down and back towards the uphill, taller portions of the second baffle 214 illustrated in FIG. 3E. Once the air travels beyond the second baffle 214, it is directed over the water dam 120, through the vent openings 110, and into the attic space of the structure via the required slot that is cut into the roof deck. The changes in airflow direction and the internal filter work in conjunction to slow the airflow and help extract any wind carried precipitation, which can then drain from the vent via the drainage system that has been incorporated into the design.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. An off-peak intake vent comprising:

spaced top and bottom walls defining a cavity therebetween and a pair of lateral side walls, said bottom wall having a generally planar bottom surface having at least one vent opening formed therethrough for communicating with an opening in a roof deck, said top wall having a continuously curved portion that converges with said bottom wall at an uphill edge of said intake vent;

air intake louvers defined between said top and bottom walls; and an internal baffle system for baffling air flow between the intake louvers and the at least one vent opening of the bottom wall, the baffle system including first and second spaced baffles extending across said intake vent between said side walls, the first baffle protruding from said bottom wall towards said top wall and the second baffle protruding from said top wall towards said bottom wall, wherein said first and second baffles are arranged such that air flowing through said cavity flows over said first baffle and then under said second baffle, said first and second baffles undulating in height as they extend across said intake vent, said baffles undulating out of phase from one another.

2. The intake vent of claim 1, wherein said first and second baffles undulate in distance from said uphill edge as they extend across said intake vent, wherein said baffles undulate in distance in phase with one another.

3. The intake vent of claim 1, further comprising a plurality of spaced drainage channels in communication with respective spaced openings in said first baffle and extending towards said air intake louvers.

4. The intake vent of claim 3, wherein said air intake louvers include wind blocks for blocking air ingestion into said channels at said louvers.

5. The intake vent of claim 3, further comprising a plurality of wind diverters for diverting air away from said spaced openings in said first baffle and located proximate to said spaced openings.

6. The intake vent of claim 5, wherein said wind diverters depend from said top wall and extend over and around said channels.

7. The intake vent of claim 3, wherein said first baffle is shaped to direct water towards said channels for drainage.

8. The intake vent of claim 1, further comprising a water dam wall extending from said bottom wall across said intake vent proximate to said at least one vent opening.

9. The intake vent of claim 1, further comprising a drip edge extending over and beyond said air intake louvers for deterring water draining from said top wall of said intake vent from entering said air intake louvers.

10. The intake vent of claim 1, further comprising a plurality of support ribs extending between said top and bottom walls for supporting said top wall.

11. The intake vent of claim 10, wherein said bottom wall comprises a plurality of spaced vent openings formed therethrough and wherein said support ribs include a plurality of parallel spaced ribs positioned between said spaced vent openings for supporting a portion of the top wall above said spaced openings.

12. The intake vent of claim 1, wherein said vent includes separately formed top and bottom structures that are assembled together to form said intake vent.

13. The intake vent of claim 1, further comprising vent locating means for aligning said intake vent over said opening in said roof deck, said vent locating means comprising one or more downwardly depending tabs.

14. The intake vent of claim 1, further comprising:

means for securing a filter in said cavity of said intake vent between the spaced first and second baffles.

15. The intake vent of claim 14, wherein said means for securing said filter secures said filter at an inclined angle with respect to said bottom wall.

16. An off-peak intake vent comprising:

spaced top and bottom walls defining a cavity therebetween and a pair of lateral side walls, said bottom wall having a generally planar bottom surface having a vent defined therethrough for communicating with an opening in a roof deck;

air intake louvers defined between said top and bottom walls; and an internal baffle system for baffling air flow between the intake louvers and the vent of the bottom wall, the internal baffle system comprising first and second spaced baffles extending across said intake vent between said side walls, the first baffle protruding from a first wall of said spaced top and bottom walls in a first direction and a second baffle protruding from a second of said spaced top and bottom walls in a second direction whereby intake air is first directed in a first direction by said first baffle and then in a second direction by said second baffle, wherein said first and second baffles are arranged such that the first baffle protrudes up from said bottom wall towards said top wall and said second baffle protrudes down from said top wall towards said bottom wall and intake air flowing through said vent flows over said first baffle and then under said second baffle, and wherein said first and second baffles undulate in height as they extend across said intake vent, said baffles undulating out of phase from one another.

17. The intake vent of claim 16 wherein said first baffle includes a plurality of spaced openings formed therein for draining water towards said louvers, said intake vent further comprising a plurality of wind diverters for diverting air away from said spaced openings in said first baffle and located proximate to said spaced openings in said first baffle.

18. An off-peak intake vent comprising:

spaced top and bottom walls defining a cavity therebetween and a pair of lateral side walls, said bottom wall having a generally planar bottom surface having a vent defined therethrough for communicating with an opening in a roof deck;

air intake louvers defined between said top and bottom walls; and an internal baffle system for baffling air flow between the intake louvers and the vent of the bottom wall, the internal baffle system comprising first and second spaced baffles extending across said intake vent between said side walls, the first baffle protruding from a first wall of said spaced top and bottom walls in a first direction and a second baffle protruding from a second of said spaced top and bottom walls in a second direction whereby intake air is first directed in a first direction by said first baffle and then in a second direction by said second baffle, wherein said first and second baffles are arranged such that the first baffle protrudes up from said bottom wall towards said top wall and said second baffle protrudes down from said top wall towards said bottom wall and intake air flowing through said vent flows over said first baffle and then under said second baffle, and wherein said first and second baffles undulate in distance from said air intake louvers as they extend across said intake vent, wherein said baffles undulate in distance in phase with one another.

19. The intake vent of claim 18, wherein said intake vent further comprises support ribs extending between said top and bottom walls for supporting said top wall, wherein said support ribs intersect with said internal baffle and wherein at least some of said support ribs comprise lateral drainage gaps on a side of said internal baffle facing said vent defined through said bottom wall.

20. The intake vent of claim 1, wherein the top wall of said intake vent has a generally planar portion parallel to said bottom wall, said generally planar portion of said top wall extending from a downhill edge of said top wall, proximate to said air intake louvers, to said curved portion, wherein said intake vent has a width defined between said uphill and downhill edges and said generally planar portion extends a distance that is 50% or less of the width of the intake vent.

21. The intake vent of claim 20, wherein the width of the intake vent is 12" or less and a thickness of said intake vent defined between the generally planar portion and the bottom wall is 1" or less.

22. The intake vent of claim 21, wherein the generally planar portion extends a distance that is 40% or less of the width of the intake vent.

23. The intake vent of claim 22, wherein said curved portion overlies the at least one vent opening.

24. The intake vent of claim 20, wherein said curved portion overlies the at least one vent opening.

25. The intake vent of claim 1, wherein said curved portion has a convex shape and overlies the at least one vent opening.

* * * * *

UNITED STATES PATENT AND TRADEMARK OFFICE

CERTIFICATE OF CORRECTION

PATENT NO. : 8,292,707 B2
APPLICATION NO. : 11/943936
DATED : October 23, 2012
INVENTOR(S) : Phillip R. Grisham and Robert Bradley Holland It is certified that error appears in the above-identified patent and that said Letters Patent is hereby corrected as shown below:

Column 10, line 24, insert a --,-- after the number 16.

Signed and Sealed this
Fifth Day of February, 2013

Teresa Stanek Rea
*Acting Director of the United States Patent and Trademark Office*